United States Patent [19]

Barton et al.

[11] Patent Number: 4,828,410

[45] Date of Patent: May 9, 1989

[54] SERIAL PRINT WHEEL IMPACT PRINTER

[75] Inventors: Bruce C. Barton, Marion; John Kadlecik, Macedon, both of N.Y.

[73] Assignee: The Standard Register Company, Dayton, Ohio

[21] Appl. No.: 677,318

[22] Filed: Dec. 3, 1984

Related U.S. Application Data

[63] Continuation of Ser. No. 510,541, Jul. 5, 1983, abandoned.

[51] Int. Cl.[4] ..... B41J 1/22; B41J 9/00; B31F 1/07

[52] U.S. Cl. ..... 400/144.1; 400/143; 400/157.1; 101/3.1; 101/93.03; 101/93.19; 101/93.48; 178/38

[58] Field of Search ..... 400/144, 144.1, 157.1, 400/145, 145.1, 145.2, 146, 143, 152; 101/93.48, 93.03, 3 R, 93.18; 178/28, 29, 32, 34, 35, 38, 39, 40, 41

[56] References Cited

U.S. PATENT DOCUMENTS

| | | | |
|---|---|---|---|
| 719,202 | 1/1903 | Dennis | 101/3 R |
| 888,889 | 5/1908 | Gottschalk | 101/3 R |
| 3,232,229 | 2/1966 | Anderson | 178/39 X |
| 3,236,352 | 2/1966 | Schacht | 400/144.1 X |
| 3,514,536 | 5/1970 | Guzak et al. | 178/38 X |
| 3,838,765 | 10/1974 | Deproux | 400/144.1 X |
| 3,941,229 | 3/1976 | Becchi et al. | 400/144.1 |
| 4,037,707 | 7/1977 | Ku et al. | 400/144.1 |
| 4,091,912 | 5/1978 | Moss | 400/146 |
| 4,248,146 | 2/1981 | Miyasake et al. | 101/93.03 |
| 4,389,126 | 6/1983 | Honma et al. | 400/144.1 X |
| 4,422,784 | 12/1983 | Arzoumanian et al. | 400/144.1 X |

FOREIGN PATENT DOCUMENTS

| | | | |
|---|---|---|---|
| 0033226 | 8/1981 | European Pat. Off. | 400/144.1 |
| 0091686 | 7/1980 | Japan | 400/157.1 |
| 100089 | 6/1982 | Japan | 400/152 |
| 176190 | 10/1982 | Japan | 400/152 |

OTHER PUBLICATIONS

IBM Tech. Disc. Bulletin, by D. J. Stiles, vol. 19, No. 8, Jan. 1977, pp. 2988–2989.

IBM Tech. Disc. Bulletin, "Flexible Print Stick", Rogers, vol. 3, No. 6, Nov. 1960, p. 1.

*Primary Examiner*—Edgar S. Burr

*Assistant Examiner*—James R. McDaniel

*Attorney, Agent, or Firm*—Killworth, Gottman, Hagan & Schaeff

[57] ABSTRACT

Disclosed is an improved serial impact printer which both prints and serrates a document. The printer includes a print wheel which is rotated to position a selected character in front of an anvil. The print wheel includes a wheel-like circular member having print characters at the end of fingers which extend from the top of the print wheel's perimeter. An impact mechanism pressures the selected print character against the anvil, the document being positioned between the selected print character and impact mechanism. The impact mechanism includes a d.c. motor which turns a threaded shaft which is engaged with a threaded hole in the end of a hammer. Counterclockwise motion of the d.c. motor advances the hammer's head to pressure the back of the print character against the anvil, thereby printing and serrating the document with the selected character. Thereafter, clockwise motion of the d.c. motor restores the impact mechanism to its original position.

19 Claims, 1 Drawing Sheet

SERIAL PRINT WHEEL IMPACT PRINTER

This is a continuation of Ser. No. 06/510,541, filed July 5, 1983 and abandoned on Dec. 3, 1984.

BACKGROUND OF THE INVENTION

1. Field of the Invention

This invention relates in general to a serial printer which includes a rotatable print wheel. More particularly, this invention relates to a serial impact printer which serrates a check or other document with a protected amount field. Still more particularly, this invention relates to a serial print wheel engine for use as the protect amount print station of a check writer.

2. Description of the Prior Art

Serial printers which include a print element in the shape of a disk or cup are known in the art. In general, such printers can be divided into two types. In the first type, the print element is constantly rotating and printing takes place on the fly. In the second type, the print element stops and starts and printing takes place while the print element is stationary.

An example of a serial printer with a constantly rotating print element can be found in U.S. Pat. No. 3,461,235 (Wilcox). Examples of a serial printer with a print element that stops before printing occurs can be found in U.S. Pat. Nos. 3,707,214 (Panzo) and 4,037,707 (Ku).

Serial print elements where the print element is in the shape of a cup are also known. For example, U.S. Pat. No. 3,640,369 (Rolph) shows a print element with a cup-shaped shell having integrally formed characters on the outer surface of the shell.

In U.S. Pat. No. 4,037,707 (Ku), the sides of a cup shaped print element are formed by a plurality of fingers, each of which has a number of characters. A hammer is located in the center of the cup. Printing is accomplished by rotating the cup so that the desired finger is located between a hammer and the paper. The hammer is then fired to print the desired character.

In the cited prior art references, the hammer utilized to depress the characters against the paper provides sufficient pressure to accomplish normal printing. However, the hammer pressure is insufficient to enable the print characters to serrate the paper in the manner required to produce a protected amount field on a check or other document.

OBJECTS OF THE PRESENT INVENTION

It is the general object of the present invention to provide an improved serial printer.

It is another object of the present invention to provide a serial printer which produces high quality printing of a serrated protected amount field on a check or other document.

It is still another object of the present invention to provide a serial printer for printing serrated characters on a document wherein the print force is precisely controlled.

It is yet another object of the present invention to provide a serial printer which generates a low level of accoustical noise when operating.

It is a further object of the present invention to provide a low cost, high reliability serial printer which requires little maintenance.

The foregoing and other objects, features and advantages of the invention will be apparent from the following description of the preferred embodiment of the invention, as illustrated in the accompanying drawings.

SUMMARY OF THE INVENTION

The foregoing and other objects and advantages are achieved by providing a print wheel including a wheel-like circular member, the hub of which is rotated by a motor to position the desired print character in a print position. In the preferred embodiment, each print character is mounted on the first end of a finger-like element, the second end of each finger-like element mounted in the top of the circular member's perimeter.

Positioned within the circular member, behind the print position, is an anvil against which the back of the print character is pressured by an impact mechanism during a print operation. The impact mechanism is positioned outboard of the circular member. It includes a d.c. motor which turns a threaded shaft either clockwise or counterclockwise. The threaded shaft is coupled to a threaded hole bored in the end of a hammer. The head of the hammer is positioned in front of the print position. The hammer passes through a guide which prevents the hammer from rotating as the d.c. motor rotates. The document and an inked ribbon are fed in between the hammer's head and the print wheel and are repositioned after each character is printed.

When the d.c. motor is turned counterclockwise, the threaded shaft moves the hammer toward the anvil so that the hammer's head pushes the selected character against the anvil at a precisely controlled force. The selected character image is thus printed and serrated on the document. The d.c. motor is then rotated clockwise to restore the impact mechanism to its original position. Next, the print wheel is rotated to position the next selected character to be printed into position in front of the anvil.

DESCRIPTION OF THE PREFERRED EMBODIMENT

Figure 1:
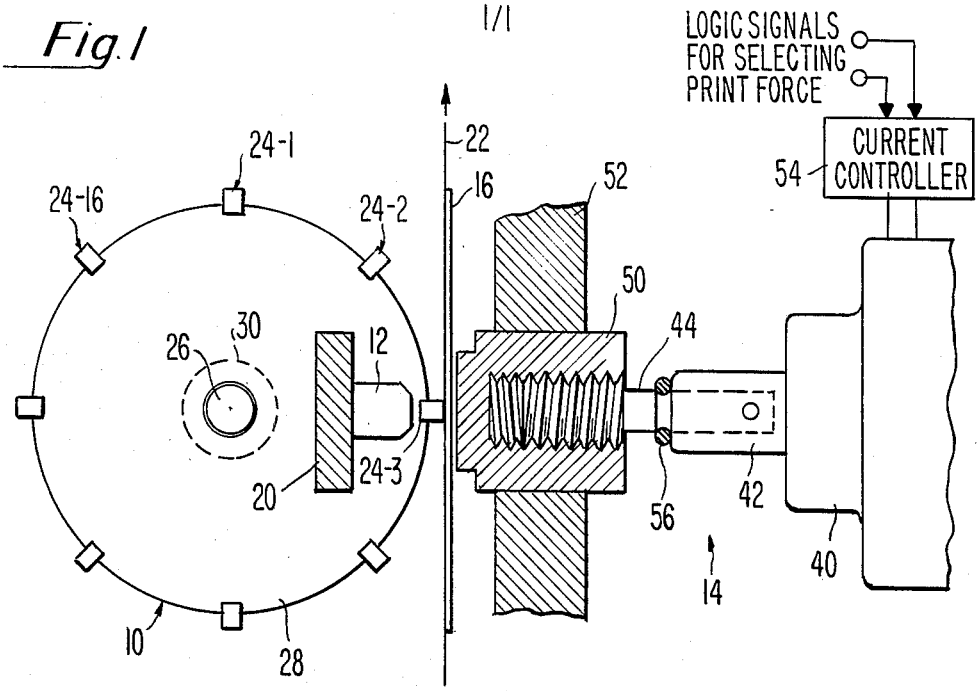
FIG. 1 shows a top view of the preferred embodiment of the present invention.

An overall view of the major elements of the printer is shown in FIG. 1. The printer includes a print wheel 10, an anvil 12, and an impact mechanism 14. A document 16 or other recording medium is positioned between the print wheel 10 and impact mechanism 14. Print wheel 10 is rotated by a motor 18. A frame 20 supports anvil 12. An inked ribbon 22 is positioned between print wheel 10 and document 16.

The document 16 and ribbon 22 are incrementally advanced in the direction shown between each print operation. For clarity and ease of illustration, the support and drive mechanisms for the ribbon 22 and document 16 are not shown. Both can be constructed from conventional drive mechanisms which are well known in the prior art.

Motor 18 selectively rotates the print wheel 10 whereby a selected print finger 24 can be positioned between anvil 12 and ribbon 22. The rotational motion of print wheel 10 stops before the impact mechanism 14 presses the ribbon 22 and document 16 against the finger 24, which is in turn pressed against the anvil 12 to print a character. In the preferred embodiment, neither the impact mechanism 14 or print wheel 10 moves across the document 16. Instead, means (not shown) reposition the document 16 prior to printing each character.

In the preferred embodiment, print wheel 10 has sixteen fingers designated 24-1 to 24-16. For clarity of illustration, not all of the fingers 24-1 to 24-16 are shown. Each of the fingers 24-1 to 24-16 has either one of the character digits 0–9 or a special character(s), the set of sixteen fingers 24-1 to 24-16 thus including all characters necessary to print a protected field on document 16. In the preferred embodiment, the characters on the fingers 24-1 to 24-16 are formed from raised line patterns. As a result, when a character is printed on the document 16, the character's line-like pattern serrates the document 16, thus providing one character of the protected amount field.

Figure 2:
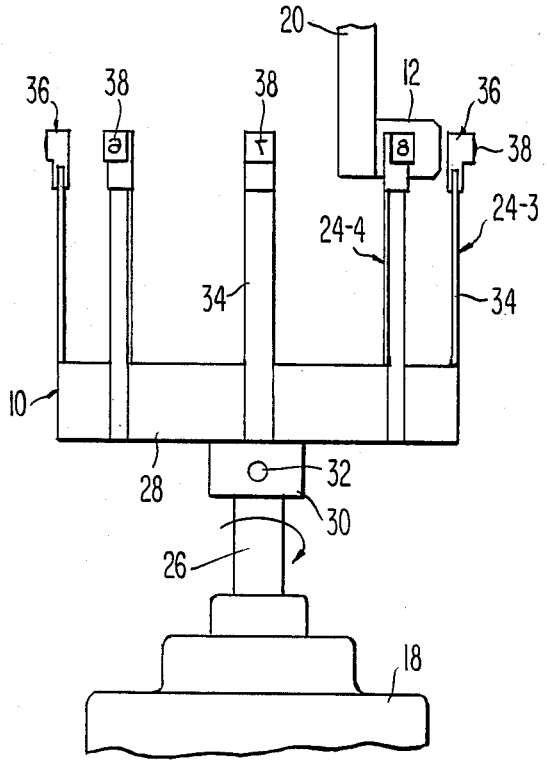
FIG. 2 is a side view of the print wheel and anvil shown in FIG. 1.

Details of how the print wheel 10 is constructed are shown in FIG. 2. Print wheel 10 is mounted on shaft 26 which is connected to motor 18. Print wheel 10 includes a wheel-like circular member 28, the hub 30 of which is connected to shaft 26 by setscrew 32. Each finger 24-1 to 24-16 is mounted in a corresponding slot in the perimeter of the circular member 28 by a semi-flexible steel bar 34. A print character element 36 is mounted on the unconnected end of each steel bar 34. A steel print character 38 is attached to the outer surface of each print character element 36.

In the preferred embodiment, a conventional stepper motor is used for motor 18. The circuitry for driving the stepper motor to position the desired finger 24 in front of anvil 12 is not shown herein since such circuitry could be conventional commercially availabel circuitry.

Referring again to FIG. 1, the operation of the impact mechanism 14 will now be explained. In the preferred embodiment, the impact mechanism 14 is driven by a conventional d.c. motor 40, such as that manufactured by Indiana General. Alternately, a conventional rotary-type solenoid such as that manufactured by Ledex can be used instead of d.c. motor 40. In the preferred embodiment, the d.c. motor 40 is characterized as rotating in either direction in response to supplied control signals. The circuitry for controlling the d.c. motor will be described below.

The shaft 42 of d.c. motor 40 is connected to threaded shaft 44 which thereby rotates the same number of degrees and in the same direction as the d.c. motor 40. The threaded end of shaft 44 is engaged with corresponding female threads machined in the end of hammer 50. Alternately, the hammer 50 may be molded with the threaded hole included, thus eliminating the need to machine the threaded hole.

In the preferred embodiment, the hammer 50 is of a semicylindrical shape and is fabricated from steel or another suitable material. The hammer 50 is slidably mounted in an aperture in guide 52.

In the preferred embodiment, the outer cylindrical surface of hammer 50 has two flat sections running along its longitudinal axis. Corresponding flat sections are also provided in the aperture in guide 52. The purpose of the flat sections is to insure that the hammer 50 does not rotate as it is moved toward or away from the print wheel 10. As an alternative, the cylindrical shape of the hammer 50 may instead be square or hexagonal with the aperture in guide 52 being similarly shaped, the object again being to prevent the hammer 50 from rotating.

In the preferred embodiment, the guide 52 is made of a material such as plastic which provides a low friction surface for the outer surface of the hammer 50 to slide against.

The operation of the printer will now be described in detail. The motor 18 is rotated to position the print finger 24 corresponding to the character selected to be printed in front of anvil 12. Either before, after or during the repositioning of print wheel 10, the ribbon 22 and document 16 are advanced to position the area of the document 16 to be printed on in front of the selected print finger 24.

Next, a first polarity d. c. current is applied to d. c. motor 40 causing it to rotate in a counterclockwise direction, thereby causing hammer 50 to be moved toward anvil 12. The level of the first polarity current is chosen to result in a specific amount of torque being generated by the d. c. motor 40. As a result, the amount of force the hammer 50 exerts against the selected print character element 36 is precisely controlled. The time duration of the first polarity current is chosen to assure that the hammer 50 will move a sufficient distance so that it bottoms out pressing the selected print character element 36 against anvil 12 with the motor 40 in a stalled condition, thereby causing the selected print character 38 to print and serrate the document 16 with the selected character. After the first polarity current has been applied for the chosen time duration, an opposite polarity current is applied to d. c. motor 40 causing it to rotate in a clockwise direction, thereby causing hammer 50 to be restored to its original position. The time duration that the opposite polarity current is applied is the same as that for the first polarity current, so that on the return stroke the hammer 50 bottoms out against return stop 56.

Thereafter, the ribbon 22, document 16, and (if necessary) the print wheel 10 are repositioned and the same operation is repeated to print the next selected character on the document 16. Of course, the above-described sequence is performed quite rapidly so that printing speed typically in the range of 3–10 cps may be achieved.

The print force is determined by the torque that motor 40 applies to threaded shaft 44. Those skilled in the art will appreciate that the torque of d. c. motor 40 is proportional to its current and that the motor 40 torque can be controlled in two ways, namely by directly controlling the current through the motor 40 with a constant current controller 54 or indirectly by controlling the voltage applied to the motor 40. In the preferred embodiment, the torque necessary to achieve the desired print force is precisely controlled by controlling the current through d. c. motor 40. The design of the current control circuitry 54 necessary to achieve a motor torque which produces the desired print force is not shown herein, but will be obvious to those of ordinary skill in the art.

Those skilled in the art will appreciate that a character to be printed having a large surface area (i.e., an "8") requires a relatively larger print force to achieve optimum serration than a character having less surface area (i.e., a "1"). By utilizing a current controller 54 to control the motor 40 current, the optimum print force may be obtained for each character printed by varying the torque generated by motor 40.

In the preferred embodiment, a standard microprocessor (not shown) receives inputs from a keyboard (not shown) used by the operator to select the character to be printed. In response to the selection of a character, the microprocessor determines whether the character selected has a relatively large, medium or small amount of surface area. Based on this determination, the microprocessor provides logic signals to the current controller 54 indicating which of three print force levels is to be utilized to print the selected character. In response to these logic signals, the current controller 54 changes the current through the motor 40 to one of three levels, the largest current level corresponding to selected characters having the largest surface area.

Various designs of the microprocessor and current controller 54 will be obvious to those skilled in the art. What is important is the fact that the motor 40 current can be precisely controlled to achieve the optimum print force.

In the preferred embodiment, the first polarity current is applied to the d. c. motor 40 for approximately 30 milliseconds and immediately thereafter the opposite polarity current is applied for 30 milliseconds. Nominally, the time duration of each of the first or opposite polarity currents causes d. c. motor 40 to rotate counterclockwise or clockwise by approximately 180 degrees, respectively. However, in actual operation, during the forward thrust, the motor 40 rotates counterclockwise until it stalls with the selected print character element 36 forced against the anvil 12. Similarly, on the return stroke, the motor 40 rotates clockwise until it stalls with the hammer 50 against the return stop 56. Typically, such stalling occurs when the motor 40 has rotated counterclockwise or clockwise by a few degrees more or less than the nominal 180 degrees.

The number of degrees the motor 40 rotates is dependent on the thread helix angle of shaft 44 and the distance the hammer 50 must travel before it bottoms out with the selected print character element 36 against the anvil 12. In the preferred embodiment, a nominal 180 degree rotation of motor 40 was chosen since the motor 40 has two sets of brushes. Thus, by rotating the motor 40 180 degrees each set of brushes gets equal wear.

Those skilled in the art will appreciate that variations in the speed of d. c. motor 40, the throw length of the hammer 50 and the thread coarseness of shaft 44 will necessitate changes in the time duration of the first and opposite currents. Those skilled in the art will further appreciate that the directions of rotation of motor 40 and the thread directions of shaft 44 and the hole in hammer 50 may be reversed without changing the direction of movement of the hammer 50 toward and away from the anvil 12.

Although the preferred embodiment of the impact mechanism is only capable of varying the level of print force in response to the character selected to be printed, those skilled in the art will appreciate that modifications may be made to additionally vary the print force depending on the number of plys in the document 16. For example, a switch may be added to enable the operator to select the number of plies in the document 16 to be printed. In response to a selected switch setting, the voltage level or current to the d. c. motor 40 can further be varied so that the torque generated by motor 40 is increased when the switch is set to a position corresponding to an increased number of document 16 plies.

As another alternative, the previously discussed microprocessor may additionally be responsive to a detector which detects the number of plies in the document 16. Based on the character to be printed and the number of plies in the document 16, the microprocessor would signal the current controller 54 to change the motor 40 current to generate a torque which will produce an optimum force to print and serrate the document 16 for each selected character.

Having shown and described the preferred embodiment of the present invention, we state that the subject matter which we regard as being our invention is particularly pointed out and distinctly claimed in the following claims. Those skilled in the art to which the present invention pertains will appreciate that equivalents or modifications of, or substitutions for, parts of the specifically described embodiment of the invention may be made without departing from the scope of the invention as set forth in what is claimed.

What is claimed is:

1. A printer comprising:

print element means for selectively positioning one of a plurality of print character elements at a position for printing, said print element means including print wheel means for supporting said plurality of print character elements, and motor means, coupled to said print wheel means, said motor means for rotating said print wheel means to position the selected print character element adjacent the print position;

an anvil, rigidly coupled to a frame, said anvil positioned within said print element means adjacent the print position, said anvil separated from said print element means by a gap; and impact mechanism means, positioned at a distance from said print element means and adjacent to the print position, for moving the selected print character element against said anvil.

2. The printer in accordance with claim 1 wherein said print wheel means includes:

a wheel-like mounting element having a central hub; and a plurality of print fingers, each one of said print fingers mounted in one of a corresponding plurality of cavities in the perimeter of said circular mounting element.

3. The printer in accordance with claim 2 wherein each of said print fingers includes a semiflexible bar having a first and a second end, the first end of each of said bars having one of said plurality of print character elements mounted on it, the second end of each of said bars mounted in one of said plurality of cavities in the perimeter of said wheel-like mounting element.

4. The printer in accordance with claim 3 wherein a section of said frame is positioned above said wheel-like mounting element, said anvil connected to that said frame section and positioned within said plurality of print character elements, said print character elements separated from said anvil by a space.

5. The printer in accordance with claim 1 wherein said impact mechanism means includes:

rotary means for providing a source of rotational torque in clockwise and counterclockwise directions; and means, coupled and responsive to said rotary means, said means for applying a force to said print element means, whereby the selected print character element is pushed into contact with said anvil means.

6. The printer in accordance with claim 2 wherein said impact mechanism means includes:

rotary means for providing a source of rotational torque in clockwise and counterclockwise directions; and means, coupled and responsive to said rotary means, said means for applying a force to the selected one of said plurality of print character elements and thereafter removing said force, whereby the selected one of said plurality of print character elements is momentarily pressed against said anvil.

7. The printer in accordance with claim 6 wherein said means for applying a force includes:

screw means, coupled and responsive to said rotary means, for transferring said rotational torque to a hammer;

said hammer having a threaded cavity in one of its ends, said threaded cavity rotatably engaged with said screw means whereby rotation of said screw means repositions said threaded cavity with respect to said anvil, said hammer for moving the selected print character element against said anvil; and guide means having an aperture therethrough said hammer passing through said aperture, said guide means for preventing said hammer from rotating.

8. The printer in accordance with claim 7 wherein said rotary means includes a d.c. motor and control means, said control means for controlling said d. c. motor to generate a torque in the clockwise and counterclockwise directions, said control means further for controlling said d. c. motor to rotate until it stalls with the selected print character element pressed against said anvil.

9. The printer in accordance with claim 7 wherein said screw means is a shaft threaded at a first end to rotatably engage the threaded cavity, the second end of said shaft connected to said rotary means.

10. The printer in accordance with claim 7 wherein said hammer is of a cylindrical shape, the cylindrical surface of said hammer having at least one flat section along its longitudinal axis, the aperture in said guide means having a shape corresponding to the surface of said hammer.

11. The printer in accordance with claim 2 wherein said impact means includes:

a motor;

a threaded shaft coupled to said motor;

a hammer threadably coupled to said threaded shaft; and a guiding member having an aperture, said aperture conforming in shape to the outer surface of said hammer, said hammer slidably mounted and passing through the aperture in said guiding member.

12. The printer in accordance with claim 11 wherein said hammer is a noncylindrical member having a threaded cavity in one of its ends, the threads of said cavity rotatably engaged with said threaded shaft.

13. A printer comprising:

print element means for selectively positioning one of a plurality of print character elements at a position for printing;

an anvil, positioned within said print element means adjacent the print position, said anvil separated from said print elements means by a gap; and impact mechanism means, positioned at a distance from said print element means and adjacent to the print position, for pressing the selected print character element against said anvil, said impact mechanism means including a motor, a threaded shaft coupled to said motor, a hammer threadably mating with said threaded shaft, and a guide member having an aperture, said aperture conforming in shape to the outer surface of said hammer, said hammer slidably mounted and passing through said aperture.

14. The printer in accordance with claim 13 wherein said hammer is a noncylindrical member having a threaded cavity in one of its ends, the threads of said cavity mating with said threaded shaft.

15. The printer in accordance with claim 14 wherein said impact mechanism means further includes control means for controlling said motor to generate a torque in clockwise and counterclockwise directions, and for controlling said motor to rotate until it stalls with the selected print character element pressed against said anvil.

16. The printer in accordance with claim 1 wherein said impact mechanism means includes:

rotary means for providing a source of rotational torque in clockwise and counterclockwise directions; and means, coupled and responsive to said rotary means, said means for applying a force to said print element means, whereby the selected print character element is pushed into contact with said anvil.

17. The printer in accordance with claim 4 wherein said impact mechanism means includes:

a motor;

a threaded shaft coupled to said motor;

a hammer threadably coupled to said threaded shaft; and a guiding member having an aperture, said aperture conforming in shape to the outer surface of said hammer, said hammer slidably mounted and passing through the aperture in said guiding member.

18. The printer in accordance with claim 17 wherein said hammer is a nonclylindrical member having a threaded cavity in one of its ends, the threads of said cavity engaged with said threaded shaft.

19. The printer in accordance with claim 1 wherein said print position is fixed with respect to said anvil means and said impact mechanism.

* * * * *